US006663041B2

(12) United States Patent
Buschulte et al.

(10) Patent No.: US 6,663,041 B2
(45) Date of Patent: Dec. 16, 2003

(54) APPARATUS FOR STORING, TRANSPORTING AND DELIVERING ROLL-FORMED FLAT PRINTING MATERIAL FOR A MACHINE PROCESSING SUCH MATERIAL

(75) Inventors: Rainer Buschulte, Beuren (DE); Erich Zahn, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 54 days.

(21) Appl. No.: 09/817,614

(22) Filed: Mar. 26, 2001

(65) Prior Publication Data

US 2001/0032900 A1 Oct. 25, 2001

(30) Foreign Application Priority Data

Mar. 24, 2000 (DE) ..... 100 14 842

(51) Int. Cl.[7] ..... B65H 19/00; B65D 85/67; B65D 19/00

(52) U.S. Cl. ..... 242/559.1; 242/588.5; 242/348.4; 242/588.6; 206/408; 206/409; 206/599

(58) Field of Search ..... 242/170, 557, 242/561, 559.1, 564.4, 598.6, 566, 588.5, 615.2, 358, 588.6, 348.2, 348.3, 348.4, 591, 592, 399.2, 598.2, 599.3, 422.5; 206/408, 409, 599

(56) References Cited

U.S. PATENT DOCUMENTS 2,570,941 A * 10/1951 Grigsby ..... 242/559.1
4,129,266 A * 12/1978 Masiello ..... 242/578.2
4,151,914 A * 5/1979 Blatt ..... 206/386
4,212,389 A * 7/1980 Robbins ..... 206/409
4,401,217 A * 8/1983 Blatt ..... 206/408
4,690,344 A * 9/1987 Yokota ..... 242/564.4
4,709,870 A 12/1987 Veith et al.
4,928,897 A * 5/1990 Satou et al. ..... 242/564.4
4,978,085 A 12/1990 Letourneau
5,053,795 A * 10/1991 Wyman ..... 242/348.4
5,163,556 A * 11/1992 Akao et al. ..... 206/394
5,287,964 A * 2/1994 Jacquand et al. ..... 206/408
5,321,475 A 6/1994 Horiuchi et al.
5,362,008 A * 11/1994 Nagel et al. ..... 242/564.4
5,390,872 A * 2/1995 Cipolla et al. ..... 242/348.4
5,579,918 A * 12/1996 McCurry ..... 206/599
5,642,811 A * 7/1997 Hubner et al. ..... 206/391
5,680,202 A * 10/1997 Blandin et al. ..... 355/72
5,868,339 A * 2/1999 Ruysink ..... 242/348.4
6,089,487 A * 7/2000 Imai et al. ..... 242/348.4
6,412,726 B2 * 7/2002 Inana et al. ..... 242/348.4

FOREIGN PATENT DOCUMENTS

| | | |
|---|---|---|
| EP | 0 334 043 A1 | 9/1989 |
| FR | 2 679 532 A1 | 1/1993 |
| GB | 2 030 959 A | 4/1980 |
| GB | 2 304 684 A | 3/1997 |

* cited by examiner

*Primary Examiner*—Michael R. Mansen
(74) *Attorney, Agent, or Firm*—Laurence A. Greenberg; Werner H. Stemer; Ralph E. Locher

(57) ABSTRACT

A device for storing, transporting and feeding a roll-forming web of printing material for a machine for processing the material. The device has a housing that surrounds and includes a receptacle for the roll. The housing is manipulatable in a manner analogous to a pallet, and is disposed for receiving and surrounding the roll, from which the web of printing material is unwindable.

10 Claims, 1 Drawing Sheet

APPARATUS FOR STORING, TRANSPORTING AND DELIVERING ROLL-FORMED FLAT PRINTING MATERIAL FOR A MACHINE PROCESSING SUCH MATERIAL

BACKGROUND OF THE INVENTION

Field of the Invention

The invention relates to a device for storing, transporting and feeding a web of printing material forming a roll, for a machine such as a printing press for processing the printing material, the printing press having a receptacle for the roll.

For printing flat printing material, such as paper, the material is fed to the machine either in the form of single sheets or in the form of a web forming a roll. For receiving such a roll, retaining devices have become known heretofore which receive the roll mounted on a roll shaft, and which have two opposed retaining parts disposed on a frame equipped with rollers. A groove is provided at the top side of each of the retaining parts, and the roll shaft is insertable into this groove from above (note, for example, the published Japanese Patent Document JP 25 77 775 Y2). Handling and storing such rolls is problematic; in particular, with regard to paper, after a protective sleeve typically surrounding the roll when it is shipped is removed, and if the roll is not soon processed completely in that state, a risk of yellowing from exposure to light especially arises, as well as also the risk of damage from moisture and mechanical factors. Equipping such a retaining device with a roll also requires expense for equipment and a lifting device for the roll.

The aforementioned published Japanese Patent Document JP 25 77 775 Y2 also discloses a device for feeding flat printing material for a machine for processing it, which thus comprises a rotatable magazine on the order of a revolver, into which a plurality of rolls can be inserted. Equipping the magazine with the rolls again involves the cost for appropriate equipment, and the magazine is not suitable for storing and transporting rolls.

SUMMARY OF THE INVENTION

It is accordingly an object of the invention to provide a simple economical device for storing, transporting and feeding a roll-forming web of printing material for a machine processing such a web, the device, while avoiding the aforementioned disadvantages, especially damage to the material forming the roll, from yellowing, moisture and mechanical factors, assures safe transport and safe storage thereof.

With the foregoing and other objects in view, there is provided, in accordance with the invention, a device for storing, transporting and feeding a roll-forming web of printing material for a machine for processing it, the device comprising a receptacle for the roll, and a housing manipulatable in a manner analogous for a pallet, the housing being disposed for receiving and surrounding the roll, from which the web of printing material is unwindable.

In accordance with another feature of the invention, the storing, transporting and feeding device includes mutually opposed, spaced-apart retaining parts, respectively, having supports disposed at the same level for receiving a roll shaft for unwinding the web of printing material, the supports being formed at least approximately as half shells and being pivotable jointly between a charging position, wherein a roll mounted on a roll shaft is feedable thereto, and an operating position, wherein the roll shaft is secured, about an axis parallel to the roll shaft, against being ejected from the half shells.

In accordance with a further feature of the invention, the half shells are supported eccentrically on the retaining parts, so as to lift a roll shaft fed to the half shells in the charging position, together with a roll, when the half shells are pivoted into the operating position, to a level that is raised a given spaced distance relative to the charging position.

In accordance with an added feature of the invention, the half shells are mechanically pivotable.

In accordance with an additional feature of the invention, the device of the invention includes a motor for pivoting the half shells.

In accordance with yet another feature of the invention, the motor is an electric motor.

In accordance with yet a further feature of the invention, the half shells are pivotable in a manner selected from the group consisting of hydraulic, pneumatic and hydropneumatic.

In accordance with yet an added feature of the invention, the device according to the invention includes a transportable base assigned to the housing.

In accordance with yet an additional feature of the invention, the base is formed analogous to a pallet.

In accordance with still another feature of the invention, the base is solidly connected to the housing.

In accordance with still a further feature of the invention, the housing is settable down on the base, and at least one centering device for orienting the housing on the base is included.

In accordance with still an added feature of the invention, the housing has a top side onto which a further housing with a base can be set down.

In accordance with still an additional feature of the invention, the device according to the invention includes a discharge device for feeding the web of printing material out of the housing.

In accordance with another feature of the invention, the discharge device has two opposed rollers, between which the web of printing material is feedable out of the housing.

In accordance with a further feature of the invention, the discharge device has a roller and an opposed sealing element, between which the web of printing material is feedable out of the housing.

In accordance with an added feature of the invention, the sealing element is a felt strip.

In accordance with an additional feature of the invention, the discharge device has two opposed sealing elements, between which the web of printing material is feedable out of the housing.

In accordance with a concomitant feature of the invention, the sealing elements are felt strips.

The housing provides protection against mechanical damage as well as protection against light, dust and moisture for the roll and makes simple handling possible.

For processing webs of printing material having varying format dimensions transverse to the processing direction, devices according to the invention with different web widths of printing material are exchanged for one another.

In a preferred construction, it is provided that opposed, spaced-apart retaining parts, respectively, having supports disposed at the same level for receiving a roll shaft for unwinding the web of printing material, the supports being embodied essentially as half shells and being pivotable jointly between a charging position, wherein a roll placed on a roll shaft can be fed thereto, and an operating position, wherein the roll shaft is secured, about an axis parallel to the roll shaft, against being ejected from the half shells.

Through this construction, the device of the invention can be equipped with a roll in a simple manner, for example, manually, by placing it on a roll shaft and feeding it together with the roll shaft, if necessary or desirable, via a ramp, to the half shells arranged in the charging position, so that the half shells, respectively, receive one end of the roll shaft. Next, the half shells are pivoted into the operating position, so that the roll shaft is secured against being ejected from the half shells. The roll is thus storable and transportable safely while being protected against mechanical damage.

In a further preferred version, provision is made for the half shells to be supported eccentrically on the retaining parts, so that upon the pivoting of the half shells into the operating position, a roll shaft and a roll, fed to the half shells in the charging position, can be lifted to a level that is raised by a spaced distance h relative to the charging position. In this way, for example, with the aid of a ramp or the like, the roll can be placed in the half shells which are in the receiving position, and when the half shells pivot into a storage position, the roll can be lifted to a level at which the roll can rotate freely in the half shells without coming into contact with the floor.

The half shells can be pivotable in any arbitrary manner, such as mechanically, manually, by motor and, in particular, electric motor, hydraulically, pneumatically, or hydropneumatically.

The housing preferably rests on a transportable base, which can be handled or manipulated by known transporting devices, such as forklifts, lift trucks, roller conveyors, or the like. In a preferred version, the base is embodied analogously to a pallet, and in particular analogously to a standard pallet ("Düsseldorfer Palette", "Euro-Pool-Palette", "Industriepalette", and so forth). Depending upon the construction, the housing is either separable from the base or solidly connected thereto.

For a proper setup of the separably embodied housing on the base, centering devices are preferably provided.

The housing preferably has a top side, onto which a further housing, provided with a base, can be set down, so that it is possible to keep a plurality of rolls on hand in a space-saving manner, or to simultaneously print more than one web. This kind of housing, which is adequately stable, can for example be provided with a structure that is adapted to the base of a device stacked above it. To that end, the underside of the base and the top side of the housing have structures adapted to one another, preferably structures that mesh by positive engagement with one another.

A discharge device for removing the web of printing material from the housing can, for example, have two opposed rollers, between which the web of printing material can be passed. These rollers are preferably not driven, and roll along the web of printing material.

Alternatively, the discharge device can also have one roller and one opposed sealing element, or two opposed sealing elements, along which the web of printing material slides. Felt strips are employed, in particular, as the sealing elements.

Other features which are considered as characteristic for the invention are set forth in the appended claims.

Although the invention is illustrated and described herein as embodied in a device for storing, transporting and feeding flat printing material for a machine processing such material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
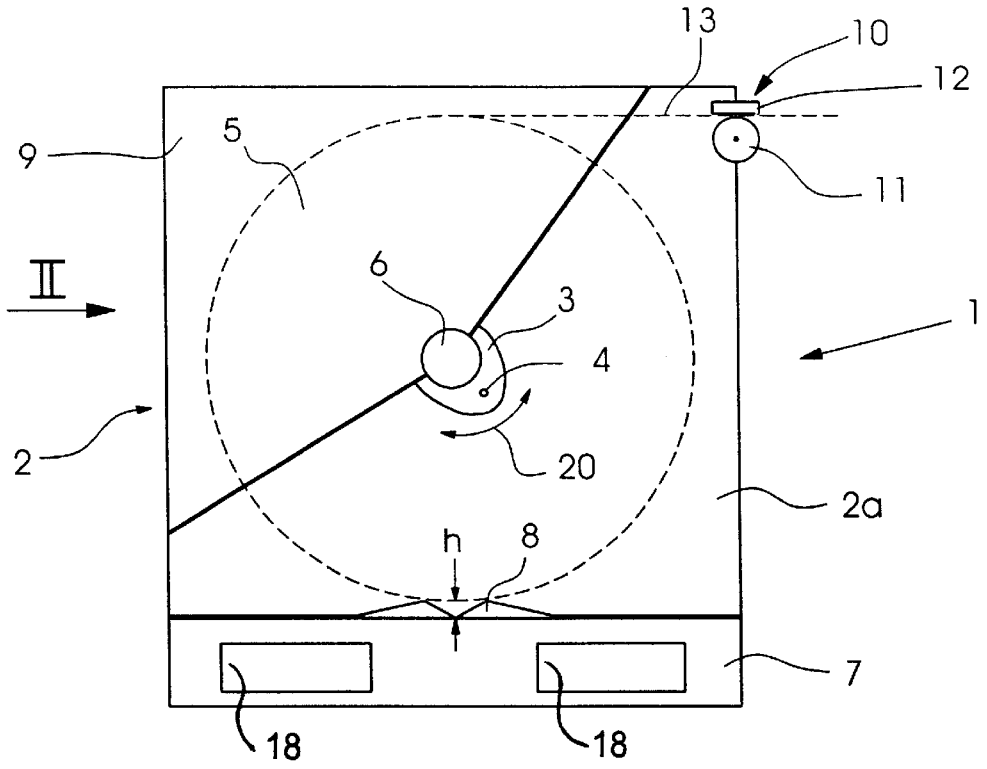
FIG. 1 is a diagrammatic side elevational view of an embodiment of the storing, transporting and feeding device according to the invention, having half shells oriented in operating position thereof.

Referring now to the drawing and, first, particularly to FIG. 1 thereof, there is shown therein an embodiment of a device 1 according to the invention for storing, transporting and feeding a web of printing material forming a roll 5 for a machine, such as a printing press, for processing flat printing materials. The device 1 has a housing 2 with two opposed, spaced-apart retaining parts 2*a*, respectively, having a support embodied as a half shell 3, for a shaft 6 bearing the roll 5. The half shells 3 are supported eccentrically on the retaining parts 2*a* and are pivotable in the directions of the double-headed arrow 20 about an axis 4 extending parallel to the roll-bearing shaft 6, in order to pivot the half shells 3 between an operating and a storage position, respectively, as shown in FIG. 1, and a charging and receiving position, respectively. While the roll 5 mounted on the roll shaft 6 is feedable at least approximately horizontally, if necessary or desirable, via a ramp to the half shells 3 disposed in the non-illustrated charging position, the roll shaft 6 in the operating position (shown in FIG. 1) of the half shells 3 is secured in the half shells 3, and the roll 5 is raised a distance h relative to the non-illustrated receiving position to a level whereat it is supported freely rotatably and, while in this state, it can be freed of any surrounding packing or packaging, for example.

The housing 2 surrounds the roll 5 placed therein, and includes a covering 9 constructed and movable in a manner as to be capable of uncovering an opening in the housing 2, which makes it possible for the housing 2 to be equipped with a respective roll 5.

The housing 2 rests on a base 7 formed as a pallet, in particular, a standard pallet; the base 7 can be integrated with the housing 2. The housing is oriented on the base by the centering device 8. As shown in FIG. 1, the base 7 has recesses or openings 18 by which a lift mechanism such as a forklift truck can engage the base 7 and lift the base and the housing with which it is associated, in a manner analogous to the way a standard forklift would lift a pallet. In an upper portion of the housing 2, a discharge device 10 for discharging the web of printing material is provided which, in the version shown, has a roller 11, in particular, a non-driven roller, and an opposed sealing element 12, such as a felt strip, and between the roller 11 and the sealing element 12, the web of printing material 13 can be removed from the housing 2.

Figure 2:
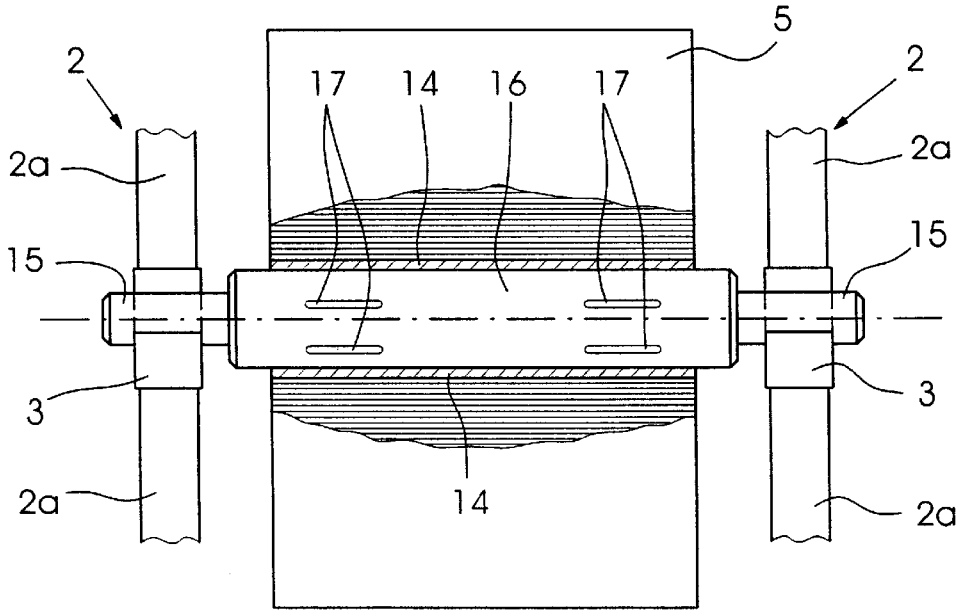
FIG. 2 is a front elevational view of FIG. 1, as seen in the direction of the arrow II therein.

As is apparent from FIG. 2, the roll shaft 6 is supported in the half shells 3 of the device 1 by journals 15 at the ends of the shaft 6. The web of printing material 13 is wound onto a winding core, embodied herein as a cardboard tube 14, which is slipped onto the shaft body 16. In order to dispose the cardboard tube 14 on the shaft body 16 in a manner that it is fixed against rotation relative to the shaft body 16, the latter is equipped with clamping elements 17, so that the cardboard tube 14 is retained by a frictional lock on the shaft body 16.

We claim:

1. A device for storing and transporting a roll of printing material, comprising a housing for receiving and surrounding the roll of printing material, said housing being a dispenser for the printing material unwound from the roll, mutually opposed, spaced-apart retaining parts having supports disposed at a given height, a roll shaft for carrying the roll of printing material, said supports being formed as shells and being pivotable jointly, about an axis parallel to said roll shaft, between a charging position, having the roll mounted on said roll shaft feedable thereto, and an operating position, having said shells preventing said roll shaft from being ejected out of them, said shells being supported eccentrically on said retaining parts for lifting said roll shaft fed to said shells in said charging position, together with the roll, upon said shells pivoting into the operating position, to a level raised a given spaced distance relative to the charging position, and a base supporting said housing and adapted to be picked up.

2. The device according to claim 1, wherein said shells are mechanically pivotable.

3. The device according to claim 1, wherein said base and said housing are detachably connected to each other.

4. The device according to claim 3, wherein said housing is to be set down on said base, and including at least one centering device for orienting the roll of printing material on said base.

5. The device according to claim 1, wherein said base is solidly connected to said housing.

6. The device according to claim 1, wherein said housing has a top side, onto which a further housing with a base can be set down.

7. The device according to claim 1, including a discharge device having two opposed elements, between which the printing material is feedable out of said housing.

8. The device according to claim 7, wherein said elements include at least one felt strip.

9. The device according to claim 1, wherein said base has openings to enable lifting of said housing supported on said base.

10. The device according to claim 1, including at least one centering device associated with said base.

* * * * *